United States Patent [19]

Swiatkowski et al.

[11] Patent Number: 4,514,290

[45] Date of Patent: Apr. 30, 1985

[54] FLOTATION COLLECTOR COMPOSITION AND ITS USE

[75] Inventors: Piotr Swiatkowski, Huddinge; Thomas Wiklund, Nacka, both of Sweden

[73] Assignee: KenoGard AB, Stockholm, Sweden

[21] Appl. No.: 471,006

[22] Filed: Mar. 1, 1983

[30] Foreign Application Priority Data

Mar. 5, 1982 [SE] Sweden ..... 8201363

[51] Int. Cl.[3] ..... B03D 1/14

[52] U.S. Cl. ..... 209/166; 252/61

[58] Field of Search ..... 252/61; 209/166, 167

[56] References Cited

U.S. PATENT DOCUMENTS 2,297,664 9/1942 Tartaron ..... 209/167
4,139,481 2/1979 Wang et al. ..... 252/61
4,206,045 6/1980 Wang et al. ..... 209/166
4,358,368 11/1982 Hellsten et al. ..... 252/61
4,425,229 1/1984 Baron et al. ..... 252/61

FOREIGN PATENT DOCUMENTS 1155072 10/1963 Fed. Rep. of Germany ..... 209/167

*Primary Examiner*—Bernard Nozick
*Attorney, Agent, or Firm*—Fred Philpitt

[57] ABSTRACT

A flotation collector composition comprises a combination of fatty acids, amidocarboxylic acids or amidosulfonic acids and partial esters of phosphoric acid and alkoxylated alcohols. The collector composition is used for upgrading nonsulfide minerals containing alkaline earth metals by froth flotation. Minerals such as apatite, calcite, scheelite, fluorspar, magnesite and baryte can be separated from the gangues using the collector composition.

13 Claims, No Drawings

FLOTATION COLLECTOR COMPOSITION AND ITS USE

The present invention relates to a flotation collector composition comprising fatty acids, amido carboxylic acids or amidosulfonic acids and certain phosphate esters. The invention also relates to the use of such compositions in froth flotation for enriching nonsulfide minerals containing alkaline earth metals, such as calcium, barium and magnesium.

Minerals containing alkaline earth metals, such as apatite, scheelite, magnesite and baryte, are in the ores usually associated with silicates, silica, different iron minerals, e.g. hematite and magnetite, etc. and they are generally separated from these gangues by flotation methods.

It is very well-known to use fatty acids in the flotation of different minerals and fatty acids are usually used in all flotation of apatite. However, fatty acids as the sole collector reagent often give unsatisfactory metallurgical results, particularly when the minerals are finely divided. When fatty acids are used it is often necessary to have long periods of conditioning or alternatively to charge the acids in the form of highly diluted solutions. It is also well-known to use amidocarboxylic and amidosulfonic acids for flotation of different minerals. In most cases amidocarboxylic and amidosulfonic acids give better metallurgical results than the fatty acids. The amido acids are, however, comparatively expensive and they often give rise to an undesirably high degree of foam formation and the foam has a high stability. Use of combinations of fatty acids and amidocarboxylic acids or amidosulfonic acids for flotation of minerals such as wolframite and scheelite has been suggested in the German Auslegeschrift No. 1 155 072. Fatty acid soaps control the foam formation and also lead to some improvement in the purity of the obtained products.

According to the present invention it has been found that a composition of fatty acid, amidocarboxylic acid or amidosulfonic acid and certain phosphate esters is particularly useful as collector reagent in froth flotation and especially for upgrading nonsulfide minerals containing alkaline earth metals. The phosphate esters are esters of (ortho)phosphoric acid and alkoxylated alcohols. The combinations of the invention give a considerable improvement of the metallurgical results, in the form of higher yields and/or more pure concentrates. The combinations are very easy to handle and can for example be added to the mineral pulp in the form of undiluted product and this without requirements on longer conditioning times.

The present invention thus relates to a flotation collector reagent which comprises (a) a fatty acid or a salt thereof, (b) an amidocarboxylic acid or an amidosulfonic acid containing an organic hydrophobic group, or a salt thereof, and (c) a partial ester of phosphoric acid and at least one alkoxylated alcohol.

The term fatty acid is used herein for monocarboxylic acids containing a straight or branched, saturated or unsaturated hydrocarbon group having 14 to 22 carbon atoms. As examples of suitable fatty acids can be mentioned lauric, palmitic, stearic and oleic acid. In a conventional manner the fatty acids can be used in the form of salts instead of as free acids, alkali metal salts or ammonium salts can for example be used. Sodium salts are preferred.

The amidocarboxylic acids and the amidosulfonic acids which are used in the present collector combinations can be characterized by the general formula $R—X—(CH_2)_n—A$, wherein x is the group

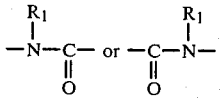

and A is the carboxylic acid group or the sulfonic acid group. R is the organic hydrophobic group which suitably has 7 to 30 carbon atoms. $R_1$ is hydrogen or an alkyl group having 1 to 4 carbon atoms and n is an integer between 1 and 8.

The hydrophobic group in the amidoacids can be a straight or branched, saturated or unsaturated aliphatic group. Non-interfering, inert substituents can be present in the group and hereby should be understood substituents which do not have any essential effect on the hydrophobic character of the group or on the affinity of the compounds to the minerals which shall be flotated, the substituents can for example be ether or ester bridges. The hydrophobic aliphatic group suitably contains 7 to 30 carbon atoms and preferably 11 to 22 carbon atoms. As has been mentioned, $R_1$ is hydrogen or an alkyl group having 1 to 4 carbon atoms and n is an integer between 1 and 8, suitably between 1 and 6. In the above given formula X is preferably the group

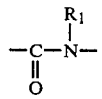

wherein $R_1$ has the above given meaning. A is preferably a carboxylic acid group. The preferred amido acids can thus be termed condensation products of fatty acids and aminocarboxylic acids.

As for the fatty acids, the amidocarboxylic and amidosulfonic acids can of course be used in the form of salts instead of as free acids. Alkali metal salts or ammonium salts of the acids can for example be used. Sodium salts are preferred.

As examples of some suitable amidocarboxylic acids and amidosulfonic acids can be mentioned dodecylamido propionic acid, dodecylamido acetic acid, oktadecylamido propionic acid, octadecylamido acetic acid, octadecenylamido propionic acid, octadecenyl-N-methyl-amido acetic acid, dodecylamido ethanesulfonic acid, octadecylamido propanesulfonic acid, octadecenyl-N-methyl-amido ethanesulfonic acid etc.

According to the present invention the above mentioned previously known collector reagents are combined with a further substance of quite a different chemical type, namely partial esters of phosphoric acid and alkoxylated alcohols. By partial ester should be understood that this component essentially is a partial ester of phosphoric acid, i.e. an ester wherein not more than two of the original acid groups have been esterified. However, many commercial products of this kind contain small amounts of completely esterified phosphoric acid, obtained as byproduct at the production, and such products can of course also be used. The phosphoric acid ester here is thus essentially a mono- or diester, or a mixture of mono- and diesters, of phosphoric acid and alkoxylated alcohols, preferably ethoxylated alcohols.

The phosphoric acid mono- and diesters can be characterized by the general formulae

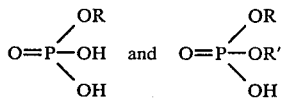

wherein R is the rest of the alkoxylated alcohol. The alcohol rest contains 1 to 10, preferably 2 to 5, alkylene oxide groups which can be ethylene oxide, propylene oxide or isopropylene oxide groups, or mixtures of these. The alkylene oxide groups are suitably ethylene oxide groups. The original alcohol should be hydrophobic and contain at least 6 carbon atoms. It can be aliphatic or be an alkylaryl alcohol, e.g. nonylphenol. Aliphatic, cyclic or acyclic alcohols having 6 to 20, suitably 12 to 18, carbon atoms are preferred. The alcohols can be straight or branched, saturated or unsaturated. R' can be an alcohol rest as above, i.e. have the same meaning as R, or be a rest of such an alcohol which is not alkoxylated. R and R' are preferably both rests of alkoxylated alcohols and can or course be rests of different such alcohols. The acid groups of the phosphoric acid which are not esterified can of course be in the form of salt, e.g. be an alkali metal salt or an ammonium salt. As has been mentioned these types of compounds are commercially often mixtures of mono- and diesters and they also often contain small amounts of triesters. With respect to surface activity the compounds are classed as anionic.

The above mentioned three different components, fatty acid, amido acid and phosphoric acid ester, can be combined within fairly wide weight ratios and thereby give a surprisingly good metallurgical effect. It is suitable to use 5 to 85 percent by weight of fatty acid, 10 to 75 percent by weight of amidocarboxylic acid or amidosulfonic acid and 3 to 40 percent by weight of phosphate ester. The given percentages are for undiluted combinations of the three active collector reagents. The compositions are adjusted for optimum effect within these ranges with respect to the composition of the ore to be treated. Generally it can be said that it is suitable to use more of the phosphate ester when smaller amounts of amido acids are used. Particularly efficient compositions consist of 20 to 65 percent by weight of fatty acid, 20 to 70 percent by weight of amidocarboxylic acid or amidosulfonic acid and 5 to 25 percent by weight of phosphate ester.

Particularly preferred compositions comprise a fatty acid having 14 to 22 carbon atoms, an amidocarboxylic acid having the general formula

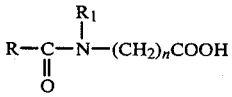

wherein R is an aliphatic group having 7 to 30 carbon atoms, $R_1$ is hydrogen or an alkyl group having 1 to 4 carbon atoms and n is an integer of 1 through 6, and a partial ester of phosphoric acid and an aliphatic alcohol alkoxylated with 1 to 10 ethylene oxide groups.

The present invention also relates to the use of collector reagent compositions, as defined, for separation of non-sulfide minerals containing alkaline earth metals from the gangues by froth flotation under neutral or alkaline conditions whereby the mineral containing alkaline earth metal is obtained as foam product.

According to the invention the combination of fatty acid, amido acid and phosphate ester is used for separation of minerals containing alkaline earth metals, preferably minerals containing calcium, barium and/or magnesium, from their gangues. As examples of representative minerals which can be upgraded can be mentioned apatite, calcite, fluorspar, scheelite, magnesite and baryte. These minerals occur naturally in ores with silica, silicates and different iron minerals and can be separated from these gangues with very good results. In other aspects the flotation is carried out in a conventional manner, i.e. a pulp of the raw minerals is prepared and, after optional conditioning, subjected to treatment with gas or air in the presence of the collector combination. The minerals containing alkaline earth metals will hereby be hydrophobed and obtained as froth product while the gangues will be removed as tailings. The flotation is carried out under neutral or alkaline conditions at a pH above 6. The pH at the flotation should preferably be above 8. At the flotation conventional auxiliary chemicals can of course be used, for example depressors and dispersants such as sodium silicate and dextrin. The amount of collector combination used at the flotation is of course dependent on the type of mineral, on the desired separation effect etc., and suitable amounts are readily found by the man skilled in the art by testing in a known manner. Generally amounts above 40 g per ton of dry mineral are used and in most cases the amount is within the range 100 to 200 or 300 g, or more, per ton.

Use of a combination according to the invention gives a considerably increased separation effect, calculated as yield or purity of the concentrate, than when combinations of only fatty acid and amido acid are used. Increased yields and increased purity is of considerable importance with respect to economy, particularly as concerns precious minerals such as scheelite, $CaWO_4$. The compositions do not give rise to any disadvantages from a practical point of view. They can be added to the pulp in pure form without being diluted with water, if desired, and this without requirements on exceptionally long conditioning times. The strong foaming tendency of the amido acids is counteracted by the presence of fatty acids in the combinations. The combinations give very good results also for varying grain sizes of the mineral.

The invention is further illustrated in the following examples which, however, are not intended to limit the same. Parts and percent relate to parts by weight and percent by weight, respectively, unless other information is given.

EXAMPLE 1

An apatite ore, containing 16.9 percent $P_2O_5$ and silicate gangue minerals and iron oxides, ground to $K_{80}$ 74 μm was upgraded by flotation. 1 kg of mineral, calculated as dry, was placed in a 3 l Agitair flotation cell with 1.5 l of water. 0.45 g of sodium silicate (40%) was added and the system was conditioned for five minutes and the collector was added and the pH adjusted to 9.5 with a 5-% NaOH-solution. After conditioning for five minutes air was blown through the system. The foam product was collected and purified twice by repeated flotation at a pH of 9.0 to 9.2.

In the table below are shown the collectors used and the results. The following components were used in the collectors:

| Test | Reagent | g/ton | Rougher concentrate $P_2O_5$ Content % | Rougher concentrate $P_2O_5$ Recovery % | Concentrate $P_2O_5$ Content % | Concentrate $P_2O_5$ Recovery % |
|---|---|---|---|---|---|---|
| 1. according to the invention | A | 95 | 30.6 | 94.9 | 36.0 | 89.1 |
| | B | 177 | | | | |
| | C | 28 | | | | |
| 2. according to the invention | A | 195 | 30.0 | 94.4 | 35.9 | 88.6 |
| | B | 105 | | | | |
| | C | 50 | | | | |
| 3. comparison | A | 104 | 30.4 | 92.1 | 35.6 | 85.0 |
| | B | 196 | | | | |
| 4. comparison | A | 227 | 27.7 | 87.6 | 35.0 | 79.2 |
| | B | 123 | | | | |

A. tall oil fatty acid
B. N—methyl-dodecylamido acetic acid
C. a mixture of mono- and diester of phosphoric acid and ethoxylated stearic alcohol (4 moles of ethylene oxide per mole of alcohol).

In the above table test number 1 should be compared with number 3 and number 2 with number 4, since in these the same total amount of collector was used and the ratio of A to B were the same.

EXAMPLE 2

Fluorspar ore of the following composition: $CaF_2$ 48.8%, $SiO_2$ 18.3%, $Fe_2O_3$ 12.2%, was ground in a rod mill to $K_{80}$ 140 μm. Moist product (1 kg as dry) was placed in a 3 l Agitair flotation cell with 1.5 l of water (20° C.) and 0.6 g of sodium silicate (40-%). The pulp was conditioned for five minutes and collector reagent was then added and pH adjusted to 9.2 with a 5-% NaOH-solution. After conditioning for additionally five minutes air was blown through. The foam product was collected for four minutes and purified twice by repeated flotation. The following components were used in the collector reagent combinations:

| Test | Reagent | g/ton | Rougher concentrate $CaF_2$ Content % | Rougher concentrate $CaF_2$ Recovery % | Concentrate $CaF_2$ Content % | Concentrate $CaF_2$ Recovery % |
|---|---|---|---|---|---|---|
| According to the invention | A | 300 | 81.9 | 95.2 | 93.3 | 87.0 |
| | B | 338 | | | | |
| | C | 112 | | | | |
| Comparison | A | 350 | 82.8 | 90.2 | 92.1 | 82.6 |
| | B | 400 | | | | |

A. oleic acid
B. a mixture of hexadecenylamido propionic acid and octadecenylamido propionic acid
C. a mixture of 45% monoester and 55% diester of phosphosphoric acid and ethoxylated oleyl alcohol (6 moles of ethylene oxide per mole of alcohol

We claim:

1. A process for separation of apatite, scheelite, magnesite, baryte, calcite or fluorspar minerals which contain calcium, barium or magnesium from silica, silicate or iron mineral gangues by froth flotation which process comprises the steps of:
(1) forming a pulp of the raw mineral,
(2) treating the pulp with an effective amount of a collector composition comprising a combination of
(a) 5 to 85 percent by weight of a fatty acid or a salt thereof,
(b) 10 to 75 percent by weight of an amidocarboxylic acid or an amidosulfonic acid, or a salt thereof, and
(c) 3 to 40 percent by weight of a partial ester of phosphoric acid and at least one alkoxylated alcohol, and
(3) separating the apatite, scheelite, magnesite, baryte, calcite or fluorspar minerals containing calcium, barium or magnesium by flotation at a pH above 6 and collecting them as froth product, and removing the gangues as tailings.

2. A process according to claim 1, wherein the flotation is carried out at a pH above 8.

3. A process according to claim 1 wherein the component (b) of the collector composition is an amidocarboxylic acid of the general formula $R—X—(CH_2)_nCOOH$, wherein X is the group

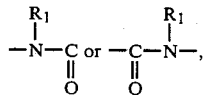

wherein R is an organic aliphatic hydrophobic group having 7 to 30 carbon atoms, $R_1$ is hydrogen or an alkyl group having 1 to 4 carbon atoms and n is an integer from 1 to 8, or a salt thereof.

4. A process according to claim 3 wherein the flotation is carried out at a pH above 8.

5. A process according to claim 3 wherein R is an aliphatic group having 7 to 30 carbon atoms and X is the group

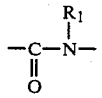

wherein $R_1$ is hydrogen or an alkyl group having 1 to 4 carbon atoms.

6. A process according to claim 5 wherein the flotation is carried out at a pH above 8.

7. A process according to claim 1 wherein component (c) of the collector composition is a partial ester of phosphoric acid and an alcohol containing at least 6 carbon atoms and alkoxylated with 1 to 10 alkylene oxide groups.

8. A process according to claim 7 wherein the flotation is carried out at a pH of above 8.

9. A flotation collector composition which comprises a combination of
(a) 5 to 85 percent by weight of a fatty acid having 14 to 22 carbon atoms or a salt thereof,
(b) 10 to 75 percent by weight of an amidocarboxylic acid or a salt thereof, and
(c) 3 to 40 percent by weight of a partial ester of phosphoric acid and at least one alkoxylated alcohol.

10. A collector composition according to claim 9 wherein component (b) is an amidocarboxylic acid of the general formula R—X—(CH)COOH, wherein X is the group

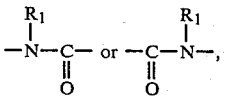

wherein R is an organic aliphatic hydrophobic group having 7 to 30 carbon atoms, $R_1$ is hydrogen or an alkyl group having 1 to 4 carbon atoms and n is an integer from 1 to 8, or a salt of the acid.

11. A collector composition according to claim 10 wherein R is an aliphatic group having 7 to 30 carbon atoms and X is the group

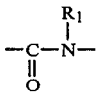

wherein $R_1$ is hydrogen or an alkyl group having 1 to 4 carbon atoms.

12. A collector composition according to claim 9, wherein component (c) is a partial ester of phosphoric acid and alcohol containing at least 6 carbonatoms and alkoxylated with 1 to 10 alkylene oxide groups.

13. A collector composition according to claim 12, wherein component (c) is a partial ester of phosphoric acid and an ethoxylated alcohol.

* * * * *